US005944109A

United States Patent [19]

Longbottom

[11] Patent Number: 5,944,109

[45] Date of Patent: Aug. 31, 1999

[54] METHOD OF COMPLETING AND PRODUCING A SUBTERANEAN WELL AND ASSOCIATED

[75] Inventor: Jim Longbottom, Magnolia, Tex.

[73] Assignee: Halliburton Energy Services, Inc., Dallas, Tex.

[21] Appl. No.: 09/135,564

[22] Filed: Aug. 18, 1998

Related U.S. Application Data

[63] Continuation-in-part of application No. 08/922,669, Sep. 3, 1997.

[51] Int. Cl.[6] ..... E21B 7/08

[52] U.S. Cl. ..... 166/313; 166/117.6; 166/50

[58] Field of Search ..... 166/117.6, 50, 166/313, 117.5

[56] References Cited

U.S. PATENT DOCUMENTS 5,325,924 7/1994 Bangert et al. ..... 166/117.6 X 5,732,776 3/1998 Tubel et al. ..... 166/313 X 5,735,350 4/1998 Longbottom et al. ..... 166/313

5,845,707 12/1998 Longbottom ..... 166/50

*Primary Examiner*—Frank Tsay

*Attorney, Agent, or Firm*—Paul I. Herman; Marlin R. Smith

[57] ABSTRACT

A disclosed method and associated apparatus provide convenient and accurate control of rates of fluid flow within a subterranean well. In one described embodiment, an apparatus has multiple tubing strings installed within multiple wellbores intersecting formations or intervals into, or from which, fluid is to be flowed. A remotely controllable flow regulating device is provided for each of the formations or intervals to regulate the rate of fluid flow through its associated tubing string. In another described embodiment, a single tubing string is utilized with multiple remotely controllable flow regulating devices interconnected therein.

28 Claims, 11 Drawing Sheets

METHOD OF COMPLETING AND PRODUCING A SUBTERANEAN WELL AND ASSOCIATED

CROSS-REFERENCE TO RELATED APPLICATION

This application is a continuation-in-part of U.S. application Ser. No. 08/922,669 filed on September 1997 and entitled "Methods of Completing and Producing a Subterranean Well and Associated Apparatus".

BACKGROUND OF THE INVENTION

The present invention relates generally to operations performed in subterranean wells and, in an embodiment described herein, more particularly provides apparatus and methods for completing and producing a subterranean well having multiple wellbores.

It is well known in the art of drilling subterranean wells to form a parent bore into the earth and then to form one or more bores extending laterally therefrom. Generally, the parent bore is first cased and cemented, and then a tool known as a whipstock is positioned in the parent bore casing. The whipstock is specially configured to deflect milling bits, drill bits, and/or other cutting tools in a desired direction for forming a lateral bore. A mill is typically lowered into the parent bore suspended from drill pipe and is radially outwardly deflected by the whipstock to mill a window in the parent bore casing and cement. Directional drilling techniques may then be employed to direct further drilling of the lateral bore outwardly from the window as desired.

The lateral bore may then be cased by inserting a tubular liner from the parent bore, through the window previously cut in the parent bore casing and cement, and into the lateral bore. In a typical lateral bore casing operation, the liner extends somewhat upwardly into the parent bore casing and through the window when the casing operation is finished. In this way, an overlap is achieved wherein the lateral bore liner is received in the parent bore casing above the window. In another type of lateral bore casing operation, the liner is completely received within the lateral bore and does not extend into the parent bore when the casing operation is finished.

The lateral bore liner is then cemented in place by forcing cement between the liner and the lateral bore. Where the liner extends into the parent bore, the cement is typically also forced between the liner and the window, and between the liner and the parent bore casing where they overlap. In this case, the cement provides a seal between the liner, the parent bore casing, the window, and the lateral bore. Where the liner does not extend into the parent bore, the cement provides a seal between the liner and the lateral bore.

Further operations may then be performed in completing and/or producing the well. For example, one or more tubing strings may be installed in the well to conduct fluids from formations intersected by the parent and lateral bores to the earth's surface, or to inject fluid into one or more of the formations. Unfortunately, these completion and/or production operations do not provide means whereby fluid flow through the tubing strings may be regulated in relatively close proximity to the formations and controlled from the earth's surface, in order to regulate rates of fluid flow from or into each of the formations, regulate the commingled proportions of fluids produced or injected into each of the formations, control rates of production or injection to comply with regulations affecting such matters, etc.

For example, a flow choke, inline orifice or other flow regulating device installed at the earth's surface is capable of influencing the rate of fluid flow through a single tubing string. However, when that tubing string conducts fluid produced from multiple formations or multiple intervals, the flow choke or inline orifice is not capable of regulating the proportional rate of fluid flow from each formation or interval. Of course, a separate flow choke or inline orifice may be provided for each formation or interval, but that would require a separate tubing string extending to the earth's surface for each formation or interval, which would be expensive and often impossible to achieve. Additionally, it is well known that wellbore storage effects make it much more desirable to regulate fluid flows in close proximity to the formations or intervals, rather than at the earth's surface.

As another example, flow regulating devices may be installed in the well, but past methods of accomplishing this have proved to be unsatisfactory. Most such flow regulating devices require intervention into the well to vary the rate of fluid flow therethrough, such as by shifting a sleeve using a shifting tool conveyed by wireline, slickline, tubing, etc. Others of such flow regulating devices obstruct the inner diameter of the tubing string in which they are installed.

From the foregoing, it can be seen that it would be quite desirable to provide a method of completing and/or producing a well which does not rely on flow regulating devices installed at the earth's surface, and which does not require intervention into the well to vary rates of fluid flow into or out of various formations or intervals, but which permits accurate and convenient regulation of fluid flow into or out of formations or intervals intersected by the well. It is accordingly an object of the present invention to provide such a method and associated apparatus.

SUMMARY OF THE INVENTION

In carrying out the principles of the present invention, in accordance with an embodiment thereof, a method is provided which permits a rate of fluid flow into or out of each formation intersected by a well to be regulated from the earth's surface. Furthermore, apparatus for facilitating performance of the method is also provided.

In broad terms, a method provided by the present invention results in a flow regulating device being installed within the well in relatively close proximity to each formation or interval intersected by the well for which it is desired to regulate the flow of fluids. The regulating devices may be remotely controllable from the earth's surface and may not require intervention into the well to vary rates of fluid flow therethrough.

In an embodiment of the invention described below, multiple tubing strings are installed in the well, with one of the tubing strings extending into a lower parent wellbore, and another of the tubing strings extending into a lateral wellbore. A flow regulating device is interconnected in the tubing string extending into the lateral wellbore, and another flow regulating device is interconnected in yet another tubing string extending to the earth's surface. Fluid flow through the tubing string extending into the lower parent wellbore is directed to an annulus disposed radially between the upper parent wellbore casing and the tubing string extending to the earth's surface and axially between two sealing devices. The flow regulating devices may be remotely controllable.

In another embodiment of the present invention described below, apparatus is provided which interconnects the three tubing strings referred to above and eliminates the need for isolating the annulus between the two sealing devices. The apparatus includes a chamber into, or from which, fluid from one of the tubing strings is flowed. One of the flow regulating devices is also disposed within the chamber to regulate flow of that fluid into, or from, the tubing string extending to the earth's surface.

In yet another embodiment of the present invention described below, each tubing string extending into a wellbore intersecting a formation or interval into, or from which, fluid flow is to be regulated is provided with a flow regulating device interconnected therein. In this way, the rate of flow of fluid into or from each formation or interval may be independently controlled. The fluid flows may or may not be directed through separate tubing strings extending to the earth's surface, or commingled in one or more such tubing strings. Each flow regulating device may be remotely controllable.

In one aspect of the present invention, a releasable deflection device is provided which enables a tubing string to be deflected off of a deflection surface positioned at an intersection of a parent and a lateral wellbore, to thereby direct the tubing string into the lateral wellbore. In one embodiment described herein, the deflection device engages a tubular structure within the lateral wellbore and releases a relatively large diameter outer housing for displacement relative to the remainder of the tubing string.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
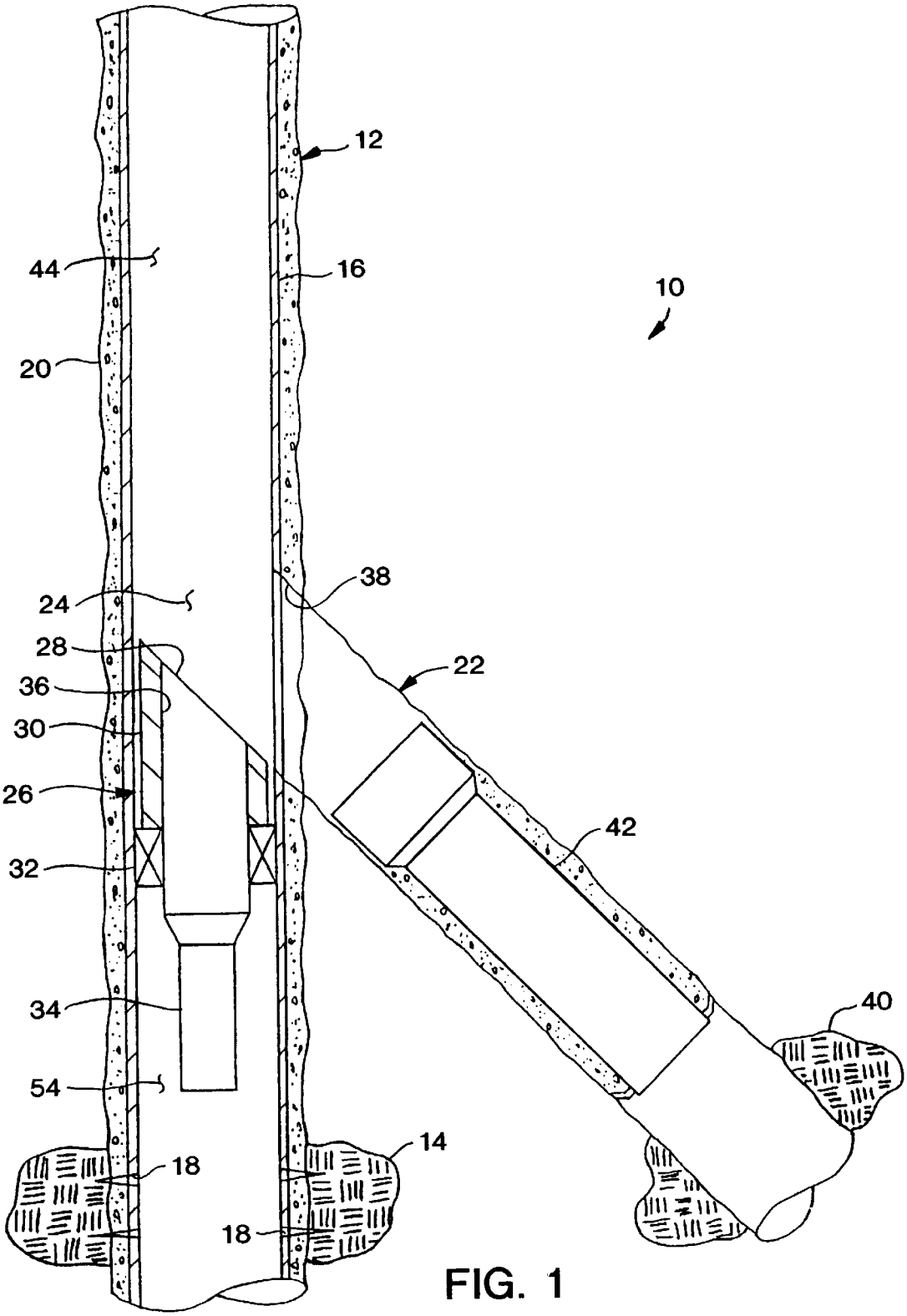
FIG. 1 is a schematic cross-sectional view through a subterranean well in which initial steps of a first method embodying principles of the present invention have been performed.
Figure 2:
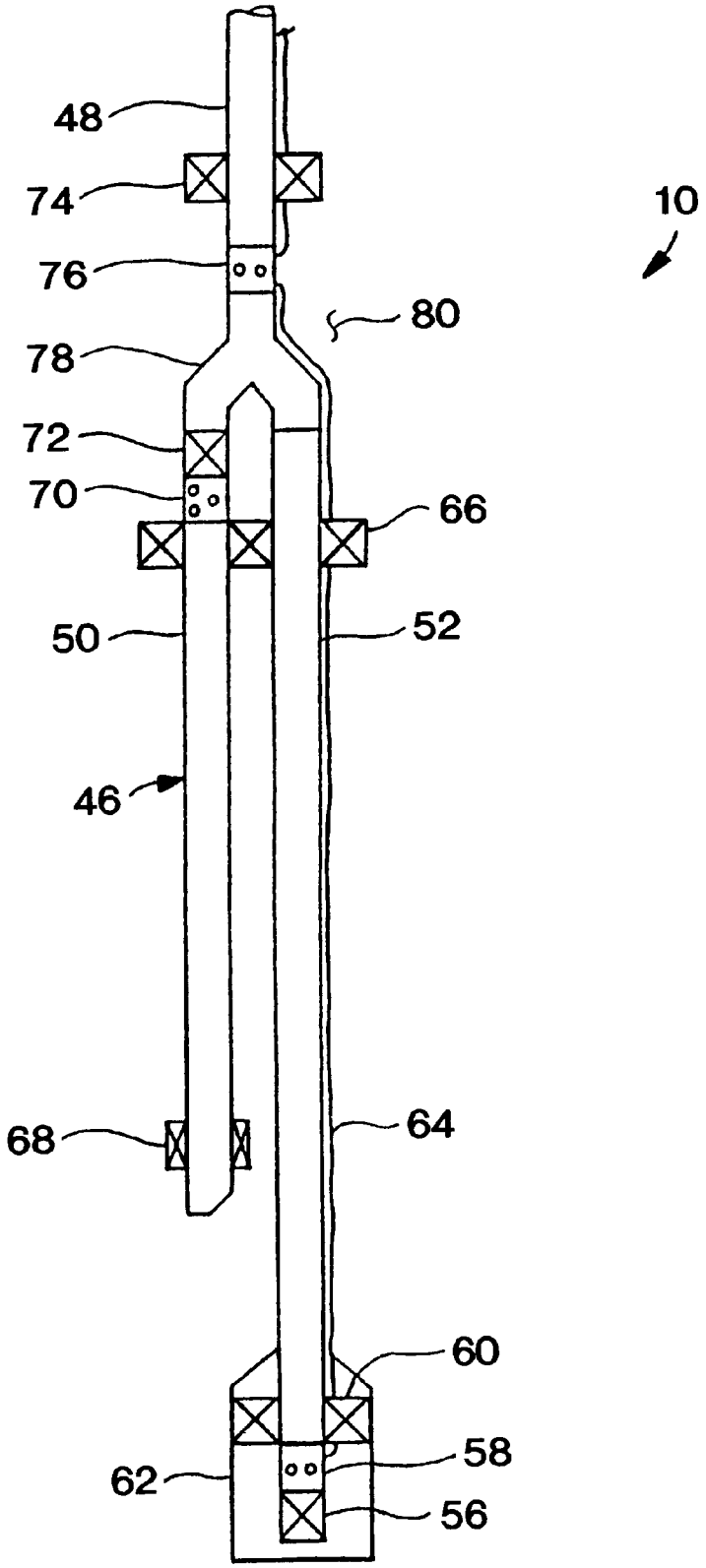
FIG. 2 is a schematic elevational view of a first apparatus embodying principles of the present invention.
Figure 3:
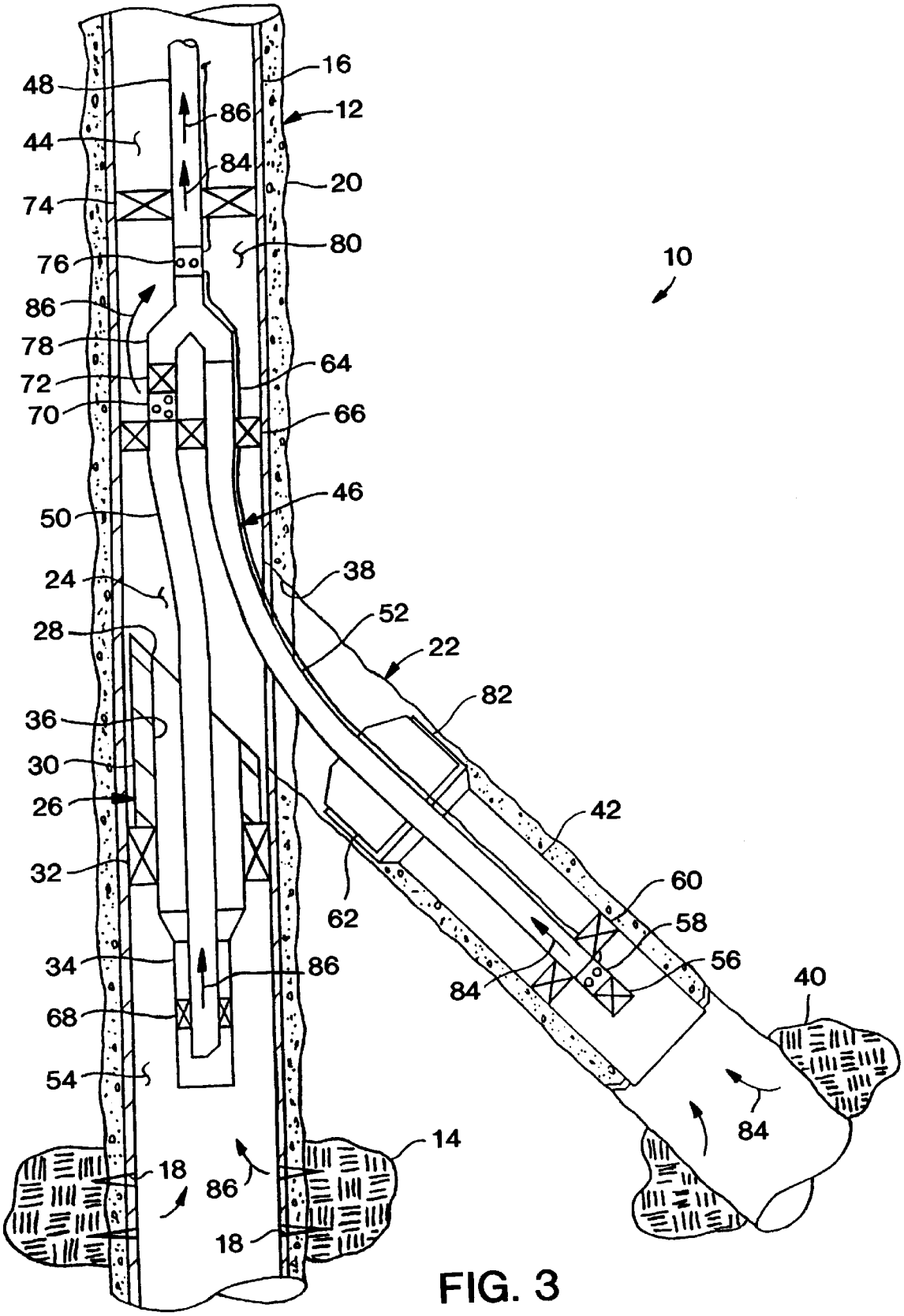
FIG. 3 is a schematic cross-sectional view of the well of FIG. 1, in which additional steps of the first method have been performed, the first apparatus having been installed in the well.

Representatively and schematically illustrated in FIGS. 1–3 is a method 10 of completing a subterranean well which embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

FIG. 1 depicts a well in which initial steps of the method 10 have been performed. A parent wellbore 12 has been drilled and intersects a formation or interval of a formation 14. As used herein, the term "formation" is used to designate either a formation or a particular interval of a formation. Casing 16 is installed in the parent wellbore 12 and cemented in place. Perforations 18 are formed through the casing 16 and cement 20 to provide flowpaths for fluid between the wellbore 12 and the formation 14.

The method 10 will be described herein as it may be utilized in producing fluids from the well, such as by flowing fluid from the formation 14 to the earth's surface through the wellbore 12. However, it is to be clearly understood that a method performed according to the principles of the present invention may also be utilized in injecting fluids into one or more formations intersected by the well. Additionally, it will become readily apparent to one of ordinary skill in the art that a method performed according to the principles of the present invention may be utilized in simultaneously injecting fluids into one or more formations intersected by the well and producing fluids from one or more formations intersected by the well.

In the method 10, a lateral wellbore 22 is to be drilled so that it intersects the parent wellbore 12 at an intersection 24. For this purpose, a whipstock assembly 26 is positioned in the parent wellbore 12 and oriented so that an upper inclined deflection surface 28 formed on a generally tubular whipstock 30 is adjacent the intersection 24 and faces toward the lateral wellbore-to-be-drilled 22. The whipstock assembly 26 is anchored to, and sealingly engaged with, the casing 16 by means of a packer 32 attached to the whipstock 30. A tailpipe 34 or other tubular member, such as a conventional PBR, is attached to, and extends downwardly from, the packer 32. Alternatively, the tubular member 34 may be a mandrel of the packer 32.

It is to be understood that the whipstock assembly 26 may include other or different elements, or substitutions may be made for the representatively illustrated elements thereof, without departing from the principles of the present invention. For example, the whipstock 30 may include an axial bore 36 which is filled with a relatively easily drillable material. The tailpipe 34 may have a conventional plug installed therein prior to, and during, drilling of the lateral wellbore 22. Various whipstock assemblies and procedures for drilling lateral wellbores, which may be utilized in the method 10, are disclosed in a copending U.S. patent application Ser. No. 08/682,051, entitled APPARATUS FOR COMPLETING A SUBTERRANEAN WELL AND ASSOCIATED METHODS OF USING SAME and filed Jul. 15, 1996, and another copending patent application having an attorney docket no. 970316 U1C1 U.S.A., entitled METHODS OF COMPLETING A SUBTERRANEAN WELL AND ASSOCIATED APPARATUS and filed Aug. 20, 1997, both of which are incorporated herein by this reference.

With the whipstock assembly 26 positioned at the intersection 24, a series of cutting tools (not shown) are utilized to form an opening 38 laterally through the casing 16 and cement 20. The lateral wellbore 22 is then drilled outwardly from the parent wellbore 12 to intersect a desired formation 40. The formation 40 may be separate and isolated from the formation 14, or the formations 14, 40 may be portions of the same formation, etc. For example, in a water flooding operation, water may be injected into the formation 14, resulting in production of hydrocarbon fluids from the formation 40.

A liner 42 or other tubular structure is lowered through an upper portion 44 of the parent wellbore 12, through the opening 38, and into the lateral wellbore 22. The liner 42 is then cemented in place. However, it is to be understood that it is not necessary for the liner 42 to be installed in this manner in the method 10. For example, the liner 42 may extend upwardly through the opening 38, across the intersection 24 and into the upper portion 44 of the parent wellbore 12, as described in the incorporated copending applications.

Referring additionally now to FIG. 2, an apparatus 46 is representatively and schematically illustrated, which embodies principles of the present invention. The apparatus 46 is utilized in the method 10 for controlling the rate of fluid flow into, or out of, the formations 14, 40 intersected by the parent and lateral wellbores 12, 22. Although the apparatus 46 is depicted in FIG. 2 as it is completely assembled when installed in the well, it is to be understood that, in actual practice, the apparatus 46 may be assembled as it is installed in the well, it may be assembled in the well after its individual elements have been installed therein in separate subassemblies, etc.

The apparatus 46 includes three interconnected tubing strings 48, 50, 52. When the apparatus 46 is installed in the well, the tubing string 48 extends upwardly to the earth's surface. The tubing strings 50, 52, which may also be referred to as tailpipes, extend downwardly from the tubing string 48. The tubing string 50 extends into a lower portion 54 of the parent wellbore 12, and the tubing string 52 extends into the lateral wellbore 22, when the apparatus 46 is installed in the well.

The tubing string 52 includes a conventional plug 56, a remotely controllable flow regulating device 58, a packer or other sealing device 60 and a releasable deflection device 62. The deflection device 62 radially outwardly surrounds the packer 60, regulating device 58 and plug 56, and extends somewhat downwardly therefrom. The deflection device 62 is utilized to direct the tubing string 52 into the lateral wellbore 22 as the apparatus 46 is lowered into the well. It is configured so that it will deflect off of the deflection surface 28 toward the lateral wellbore 22, rather than passing through the bore 36 of the whipstock 30. The deflection device 62 releases for displacement relative to the remainder of the tubing string 52 after deflecting off of the deflection surface 28. Such release of the deflection device 62 may be performed upon receipt of a signal and/or fluid pressure on lines 64 interconnected thereto, in response to engagement with a structure in the lateral wellbore 22, in response to manipulation of the apparatus 46, or any other method. An apparatus which may be used for the deflection device 62 in the method 10 is described more fully hereinbelow in relation to FIGS. 6A–6B and 7A–7D.

The regulating device 58 may be a variable choke, which is responsive to signals and/or fluid pressures, etc. carried by lines 64 coupled thereto. Signals may be sent to the regulating device 58 by other methods, as well, such as by acoustic telemetry, electromagnetic waves, magnetic fields, mud pulses, etc. However, it is to be clearly understood that the regulating device 58 may be otherwise controlled without departing from the principles of the present invention, for example, by manipulation of a latching or shifting tool engaged with the regulating device and conveyed on wireline, slickline, segmented tubing, coiled tubing, etc., by otherwise mechanically controlling the regulating device, by operating the regulating device with a Downhole Power Unit available from Halliburton Energy Services, etc.

Suitable regulating devices for use in the method 10 are described in copending patent applications, each of which is entitled FLOW CONTROL APPARATUS FOR USE IN A SUBTERRANEAN WELL AND ASSOCIATED METHODS, having attorney docket nos. 970331 U1 U.S.A. and 970332 U1 U.S.A., and each of which was filed Jul. 21, 1997 and is incorporated herein by this reference. Another suitable regulating device is the SCRAMS ICV available from Petroleum Engineering Services, Ltd. of The Woodlands, Tex. As representatively illustrated in FIG. 2, the regulating device 58 acts to regulate the rate of fluid flow through a sidewall portion of the tubing string 52, however, it is to be understood that the regulating device may alternatively regulate fluid flow axially therethrough, in which case the plug 56 may not be included in the tubing string 52.

The packer 60 may be another sealing device, such as a packing stack, seal element, etc. for sealing engagement with a seal surface, such as a PBR attached to the liner 42. A suitable packer for use in the method 10 is the remotely settable SCRAMS HF packer available from Petroleum Engineering Services, Ltd. This type of packer may be interconnected to the lines 64 and set within the liner 42, or other tubular structure, in response to signals and/or fluid pressures, etc. carried by the lines 64. Alternatively, the packer 60 may be a conventional hydraulically or mechanically settable packer having provision for passing the lines 64 therethrough. If remotely settable, the packer 60 may receive signals by acoustic telemetry, electromagnetic waves, mud pulses, or any other communication means.

A dual string packer 66 sealingly engages the tubing strings 50, 52. If the lines 64 are utilized to remotely control operation of the regulating device 58, packer 60 and/or the deflection device 62, the packer 66 may include provision for extending the lines 64 therethrough. The packer 66 is configured for sealingly engaging the casing 16 in the upper portion 44 of the parent wellbore 12 above the opening 38 when the apparatus 46 is installed in the well. The packer 66 may be hydraulically or mechanically set, and may be remotely set in response to signals and/or fluid pressures carried by the lines 64.

The tubing string 50 includes a packing stack 68 or other sealing device, a perforated sub 70 having openings formed radially therethrough and a plug 72. The packing 68 is configured for passing through the whipstock bore 36 and sealing engagement with the tailpipe 34. Alternatively, the packing 68 may be a packer configured for setting within the tailpipe 34, and may be remotely settable, as described above for the packer 60. It will be readily appreciated by a person of ordinary skill in the art that when the packing 68 is sealingly engaged within the tailpipe 34, fluid may flow from the formation 14, into a lower end of the tubing string 50, through the packer 66 and outward through the openings in the perforated sub 70.

The tubing string 48 includes a packer 74 or other sealing device and a remotely controllable flow regulating device 76. The packer 74 may be similar to the packer 60, except that it is configured for setting within the upper portion 44 of the parent wellbore 12. The regulating device 76 may be similar to the regulating device 58, and may be controlled by any of the means described above for controlling the regulating device 58.

A coupling device 78 couples the tubing string 48 to the tailpipes 50, 52. The coupling device 78 may be a conventional wye block and may include a vane or other member for directing tools, wirelines, coiled tubing, etc. from the tubing string 48 into a selected one of the tailpipes 50, 52. Of course, if access is desired to the tailpipe 50, the plug 72 should be removed therefrom. A suitable wye block for use as the coupling device 78 in the method 10 is described in a copending U.S. application Ser. No. 08/872,115 entitled WYE BLOCK HAVING A ROTARY GUIDE INCORPORATED THEREIN, filed on Jun. 10, 1997 and which is incorporated herein by this reference. Where such a directing member is included in the coupling device 78, it may be operated mechanically, hydraulically, in response to signals and/or fluid pressure carried by the lines 64, acoustic telemetry, electromagnetic waves, mud pulses, etc. The coupling device 78 may be controlled by any of those means described above for the regulating device 58.

The regulating device 76 operates to regulate the rate of fluid flow through a sidewall portion of the tubing string 48. In this way, fluid passing outwardly through the openings in the perforated sub 70, and into an annulus 80 formed radially between the tubing string 48 and the parent wellbore 12 when the apparatus 46 is installed in the well, may flow into the tubing string 48. Thus, as the apparatus 46 is representatively illustrated in FIG. 2, fluid flowing between the tubing string 48 and the tailpipe 50 does not necessarily flow through the coupling device 78. Instead, it flows into the annulus 80, thereby bypassing the coupling device 78. Alternatively, the regulating device 76 may be included in the tailpipe 50, similar to the manner in which the regulating device 58 is included in the tailpipe 52, in which case the plug 72 and perforated sub 70 would not be included in the tailpipe 50 and flow between the tubing string 48 and the tailpipe 50 would pass through the coupling device 78.

Referring additionally now to FIG. 3, the apparatus 46 is representatively illustrated as it is operatively installed in the well. The deflection device 62 has deflected the tailpipe 52 into the lateral wellbore 22 as the apparatus 46 was lowered into the well. Thereafter, since the tailpipe 50 is shorter than the tailpipe 52, the tailpipe 50 is inserted through the whipstock bore 36 and into the lower portion 54 of the parent wellbore 12. However, it is to be clearly understood that it is not necessary for the tailpipe 50 to enter the lower parent wellbore 54 after the tailpipe 52 enters the lateral wellbore 22, or for the tailpipe 50 to be shorter than the tailpipe 52, in keeping with the principles of the present invention.

The deflection device 62 has been released for axial displacement relative to the remainder of the tailpipe 52 by engaging the deflection device with an upper PBR 82 attached to the liner 42 and applying an axially downwardly directed force to the deflection device by manipulation of the apparatus 46 from the earth's surface. As described above, however, release of the deflection device 62 may be accomplished by other methods without departing from the principles of the present invention.

When the deflection device 62 is released, the tailpipe 52 extends further into the lateral wellbore 22. The packer 60, regulating device 58 and plug 56 enter the liner 42. When positioned therein as desired, the packer 60 is set so that it sealingly engages and anchors to the liner 42. The packer 60 may be set by any method, as described above.

It will be readily apparent to one of ordinary skill in the art that, with the packer 60 set in the liner 42 as representatively illustrated in FIG. 3, fluid (represented by arrows 84) may flow from the formation 40, inwardly through the regulating device 58, through the tailpipe 52, through the coupling device 78, and through the tubing string 48 to the earth's surface. Of course, if it is desired to inject the fluid into the formation 40, the fluid 84 may flow in the opposite direction.

After the tailpipe 50 has been inserted into the lower parent wellbore 54, the packing 68 sealingly engages the tubular member 34. If the packing 68 is a packer, it is set within the tubular member 34. Thereafter, the packers 66 and 74 are set within the upper parent wellbore 44, so that they sealingly engage and anchor to the casing 16. If the packers 60, 66, 68, 74 are remotely settable, as described above, they may be sequentially set by transmitting an appropriate signal to each of them and/or applying appropriate fluid pressure to each of them.

It will be readily apparent to one of ordinary skill in the art that, after the packers 66 and 74 are set and the sealing device 68 is sealingly engaged within the tubular member 34, fluid (represented by arrows 86) may flow from the formation 14, through the tailpipe 50, outward through the perforated sub 70, into the annulus 80, inward through the regulating device 76 and through the tubing string 48 to the earth's surface. Of course, if an injection operation is to be performed, the fluid 86 may flow in an opposite direction. In the method 10 as representatively illustrated in FIG. 3, the fluids 84, 86 are commingled within the tubing string 48, but it is to be clearly understood that the fluids may be segregated from each other, without departing from the principles of the present invention.

Thus has been described the method 10 and apparatus 46 which permits the rate of flow of the fluids 84, 86 to be regulated in close proximity to the formations 14, 40. The rates of each fluid flow may be conveniently varied as desired by remotely operating the regulating devices 76, 58. Additionally, proportional flow rates of the fluids 84, 86 may be controlled to thereby vary the proportions of the fluids commingled in the tubing string 48.

Figure 4A:
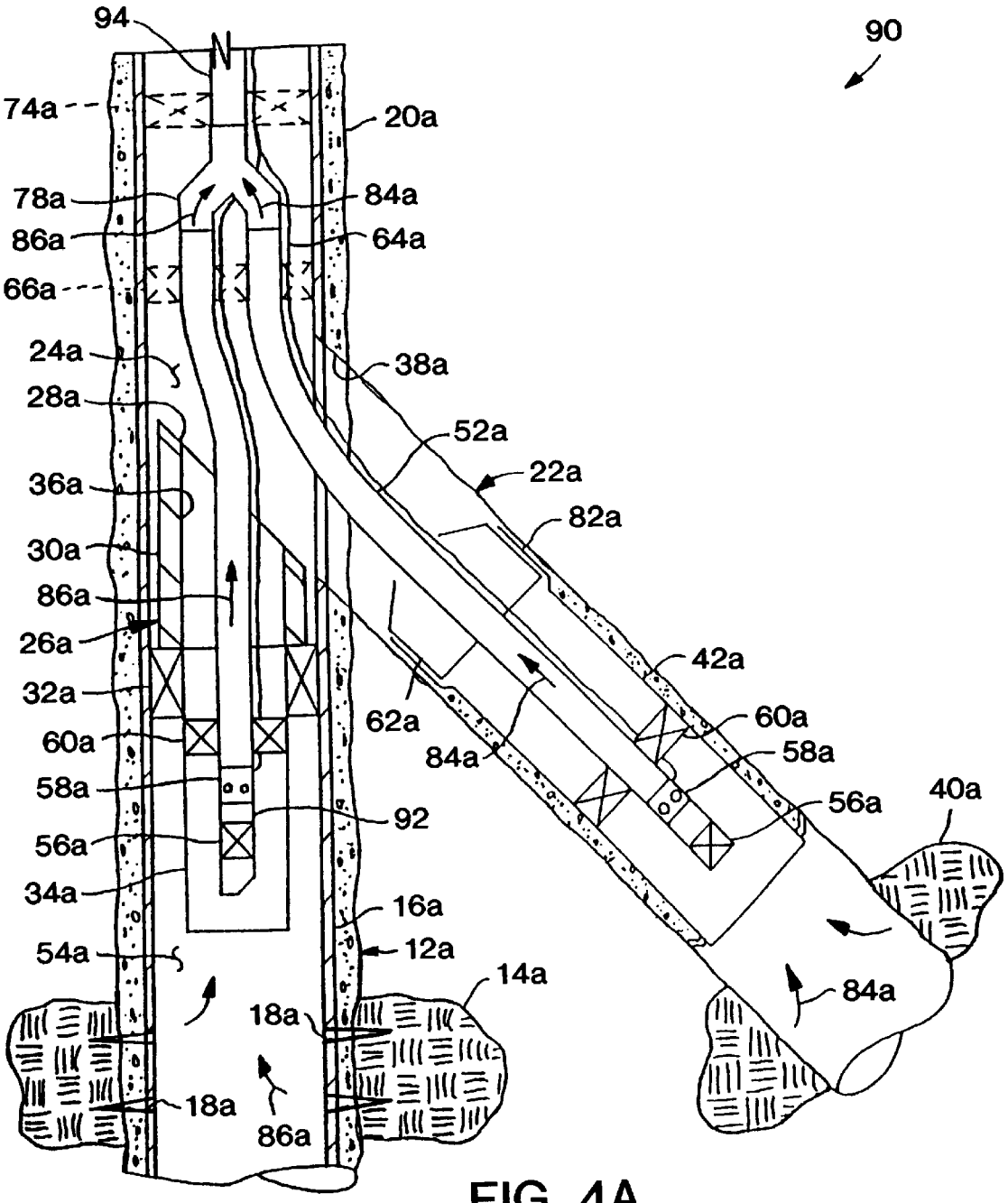
FIGS. 4A–4B are a schematic cross-sectional views of another well in which a second method and a second apparatus embodying principles of the present invention have been utilized.
Figure 4B:
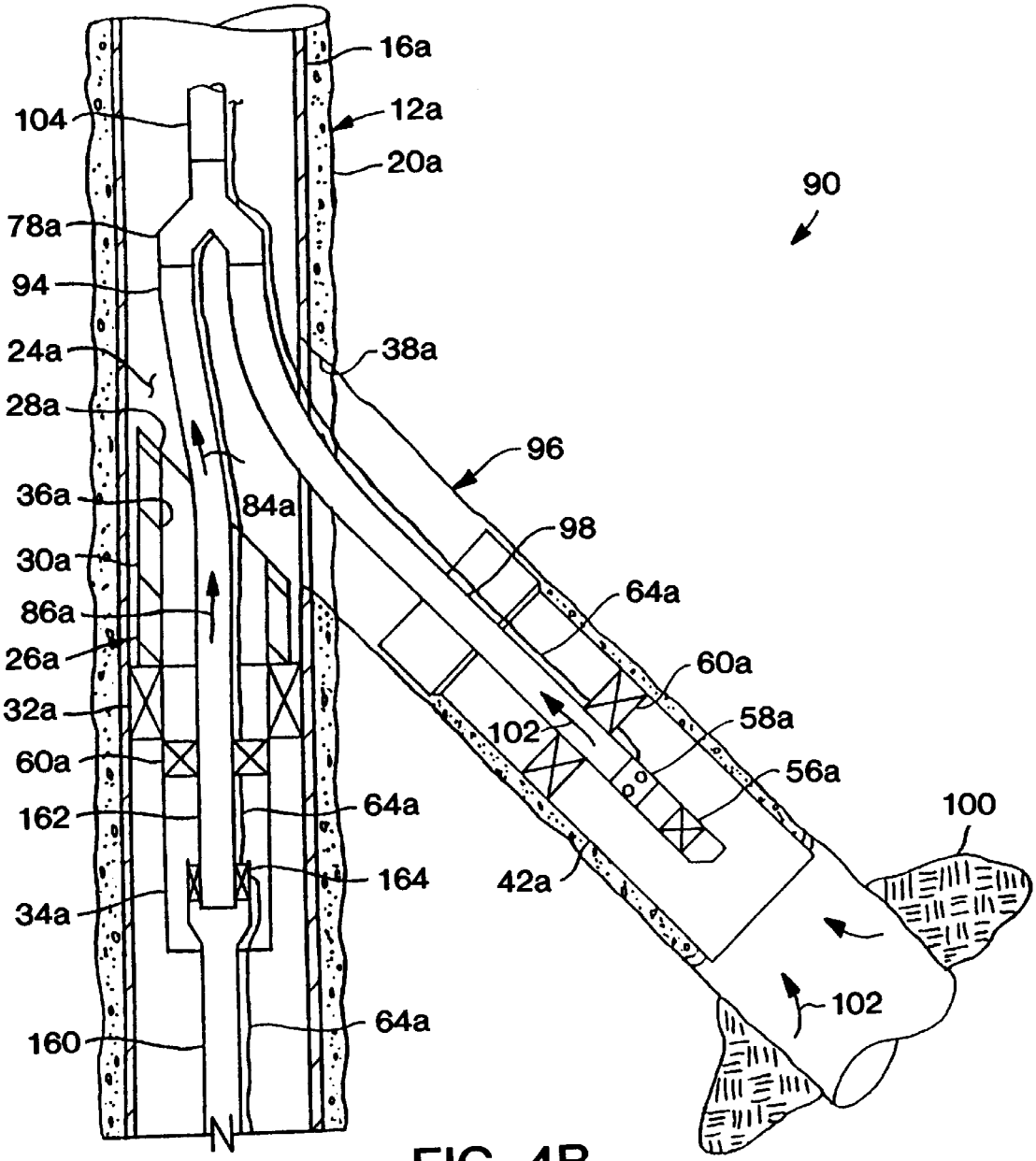

Referring additionally now to FIGS. 4A–4B, another method 90 embodying principles of the present invention is representatively and schematically illustrated. Elements of the method 90 which are similar to those previously described are indicated in FIGS. 4A–4B using the same reference numbers, with an added suffix "*a*".

The method 90 differs from the method 10 in part in that a tailpipe 92 that extends into the lower parent wellbore **54*a* includes the packer 60*a*, regulating device 58*a* and plug 56*a*, similar to that included in the tailpipe 52*a* extending into the lateral wellbore 22*a*. The packer 60*a* is set in the tubular member 34*a*. In this manner, the perforated sub 70, plug 72 and separate annulus 80 are not utilized in the method 90. Thus, fluid 86*a* produced from the formation 14*a* flows into the regulating device 58*a* below the packer 60*a* and flows through the coupling device 78*a* into a tubing string 94, wherein the fluids 84*a* and 86*a*** are commingled.

As discussed above, it is not necessary for the fluids **84*a* and 86*a* to be commingled. The packer 66*a* is shown in FIG. 4A in dashed lines to indicate that it is not necessarily or preferably utilized in the method 90 as representatively illustrated. However, it will be readily appreciated by a person of ordinary skill in the art that, if it is desired to segregate the fluids 84*a* and 86*a* from each other, the packer 66*a*** may be installed and separate tubing strings (not shown)

coupled thereto and extended to the earth's surface, in place of the coupling device 78*a* and tubing string 94. The packer 74*a* may be utilized if commingled flow in the tubing string 94 is desired.

FIGS. 4A–4B also show that the method 90 may be utilized to control fluid flow from additional wellbores and formations intersected by those wellbores. For example, an additional lateral wellbore 96 may be drilled above or below the lateral wellbore 22*a* extending outwardly from another opening 38*a* formed through the casing 16*a* and cement 20*a*, and intersecting another formation 100. Another tailpipe 98 including another set of the packer 60*a*, regulating device 58*a* and plug 56*a* may then be installed in a liner 42*a* in the lateral wellbore 96.

Fluid (represented by arrows 102) may then be flowed from the formation 100, inwardly through the regulating device 58*a*, and through the tailpipe 98. The fluid 102 may be commingled with the fluids 84*a* and 86*a* in a tubing string 104 extending to the earth's surface by providing another coupling device 78*a* interconnecting the tubing string 94, the tailpipe 98 and the tubing string 104. Alternatively, separate tubing strings may be provided for segregating the fluids 102, 84*a* and 86*a*, or any combination of them, as described above.

In FIGS. 4A–4B, the lateral wellbore 96 is depicted as being drilled above the lateral wellbore 22*a*. For this purpose, another whipstock assembly 26*a* is positioned in the parent wellbore 12, with its deflection surface 28*a* adjacent the intersection 24*a* of the parent wellbore and the upper lateral wellbore 96. The upper lateral wellbore 96 is then drilled in a manner similar to that used to drill the lower lateral wellbore 22*a*.

The tubing string 94 is segmented, so that a lower portion 160 of the tubing string 94 may be joined with an upper portion 162 thereof, after the upper lateral wellbore 96 has been drilled. For this purpose, the lower portion 160 includes a connector 164, which permits fluid communication between the upper and lower portions 160, 162, and also interconnects the lines 64*a*. The connector 164 may be of the type well known to those of ordinary skill in the art as a "wet connector". A suitable connector that may be used for the connector 164, with appropriate modification, is described in U.S. Pat. No. 5,577,925, entitled CONCENTRIC WET CONNECTOR SYSTEM.

Alternatively, the lower portion 160 may include a PBR at its upper end and the upper portion 162 may include an appropriate sealing device, such as a packing stack, at its lower end for sealing engagement with the PBR. In that case, interconnection of the lines 64*a* may be accomplished by one or more other conventional connectors. However, it is to be clearly understood that connection of the upper and lower portions 160, 162 of the tubing string 94 may be accomplished by any other means without departing from the principles of the present invention. For example, the tubular member 34*a* included in the upper whipstock assembly 26*a* could sealingly engage a PBR attached to the upper end of the lower portion 160, so that when the packer 60*a* is set in the tubular member, the upper portion 162 is in fluid communication with the lower portion 160.

With the lateral wellbore 96 drilled as described above, the tailpipe 98, upper portion 162 and tubing string 104 are installed in the well. The tailpipe 98 may be deflected to enter the lateral wellbore 96 utilizing a deflection device, such as the deflection device 62*a*, or other means may be utilized to insert the tailpipe into the lateral wellbore. The upper portion 162 is inserted through the upper whipstock assembly 26*a* and connected to the lower portion 160. The packers 60*a* on the upper portion 162 and tailpipe 98 are set in the tubular member 34*a* and liner 42*a*, respectively. Fluids 84*a*, 86*a* and 102 may then be regulated to flow at desired rates of each into the tubing string 104 and therethrough to the earth's surface.

Figure 5:
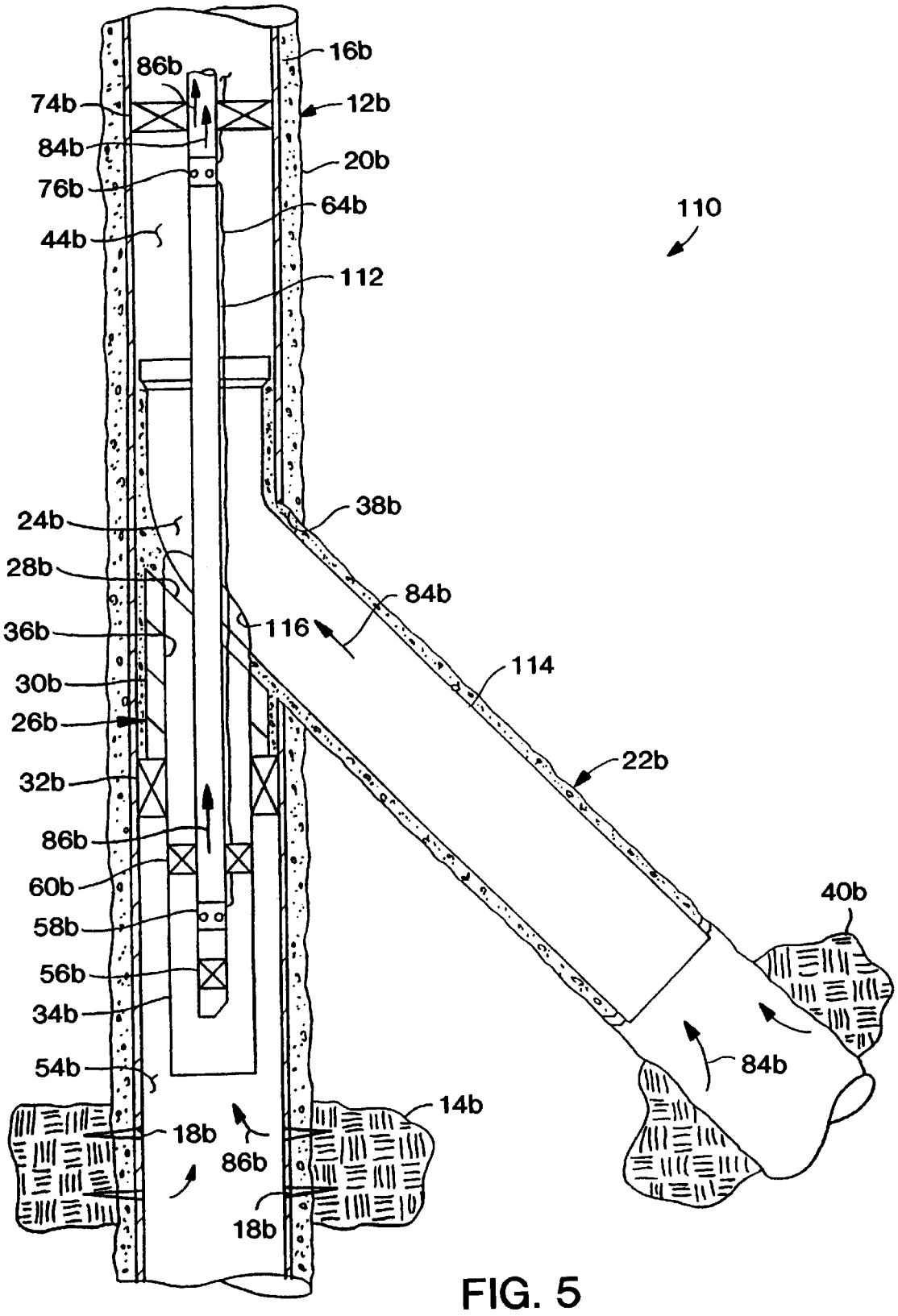
FIG. 5 is a schematic cross-sectional view of still another well in which a third method and a third apparatus embodying principles of the present invention have been utilized.

Referring additionally now to FIG. 5, another method 110 embodying principles of the present invention is representatively and schematically illustrated. Elements of the method 110 which are similar to those previously described are indicated in FIG. 5 using the same reference number, with an added suffix "*b*". The method 110 differs in substantial part from the previous methods 10, 90 in that a single tubing string 112 is utilized to regulate fluid flow from, or into, multiple formations 14*b*, 40*b*.

In the method 110, a liner 114 is installed extending into the lateral wellbore 22*b*, and remains partially received within the upper parent wellbore 44*b*. The liner 114 is cemented in place overlying the whipstock assembly 26*b*. Thereafter, an opening 116 is cut through a sidewall portion of the liner 114 to provide access to the lower parent wellbore 54*b* via the whipstock bore 36*b*.

The tubing string 112 includes two regulating devices 76*b*, 58*b* and two packers 74*b*, 60*b*. As representatively illustrated in FIG. 5, the regulating device 76*b* is interconnected between the packer 74*b* and the packer 60*b*, and the packer 60*b* is interconnected between the regulating device 76*b* and the regulating device 58*b*. However, it will be readily appreciated by a person of ordinary skill in the art that, for example, if a regulating device capable of regulating fluid flow axially therethrough is utilized in place of the regulating device 58*b*, it could be positioned between the packers 74*b*, 60*b*, and the plug 56*b* could be eliminated from the tubing string 112. Thus, other configurations of the tubing string 112 may be utilized without departing from the principles of the present invention.

The tubing string 112 is inserted through the opening 116, so that a lower portion thereof extends into the lower parent wellbore 54*b*. The packer 60*b* is set within the tubular member 34*b* and the packer 74*b* is set within the casing 16*b* in the upper parent wellbore 44*b*. As described above, if the packers 74*b*, 60*b* are remotely settable, they may be set sequentially and controlled from the earth's surface.

With the packers 74*b*, 60*b* set, the fluid 86*b* may flow from the formation 14*b*, inwardly through the regulating device 58*b*, and through the tubing string 112 to the earth's surface. The fluid 84*b* may flow from the formation 40*b*, through the liner 114, inwardly through the regulating device 76*b*, and through the tubing string 112 to the earth's surface, commingled with the fluid 86*b*. The regulating devices 76*b*, 58*b* may, thus, be utilized to independently regulate the rate of each of these fluid flows, and to control the proportions of the fluids 84*b*, 86*b* produced from the formations 14*b*, 40*b*. Of course, the flows of either or both of the fluids 84*b*, 86*b* may be reversed in an injection operation.

Figure 6A:
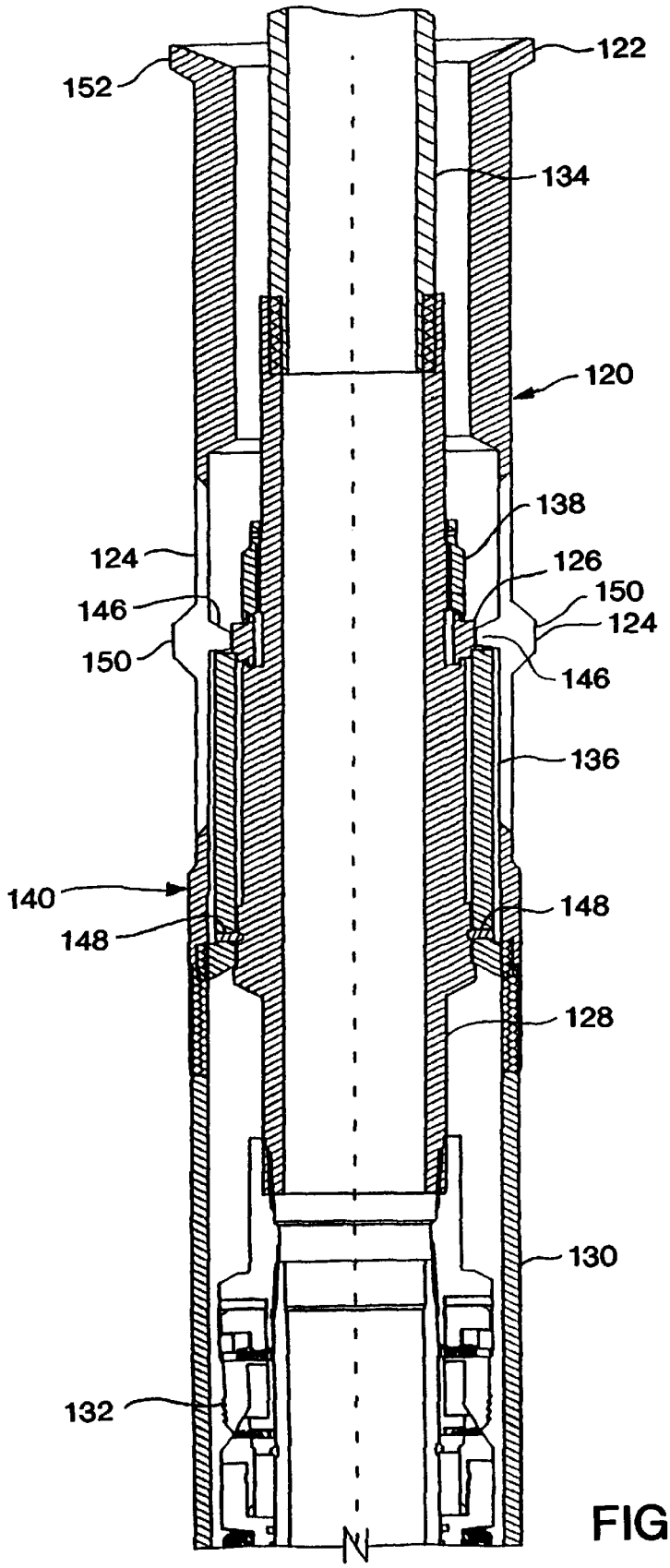
FIGS. 6A–6B are cross-sectional views of successive axial sections of a releasable deflection device embodying principles of the present invention, the device being shown in a configuration in which it is run into a wellbore.
Figure 6B:
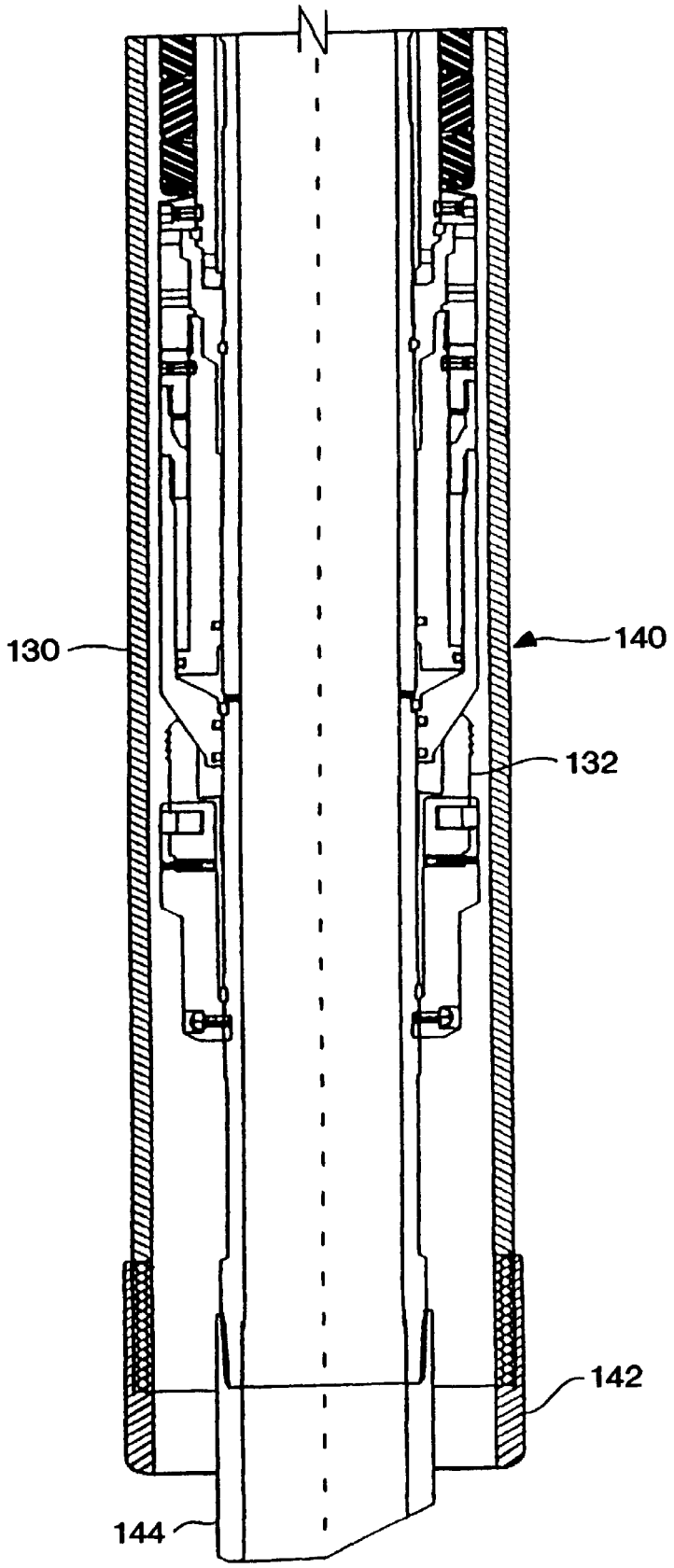
Figure 7A:
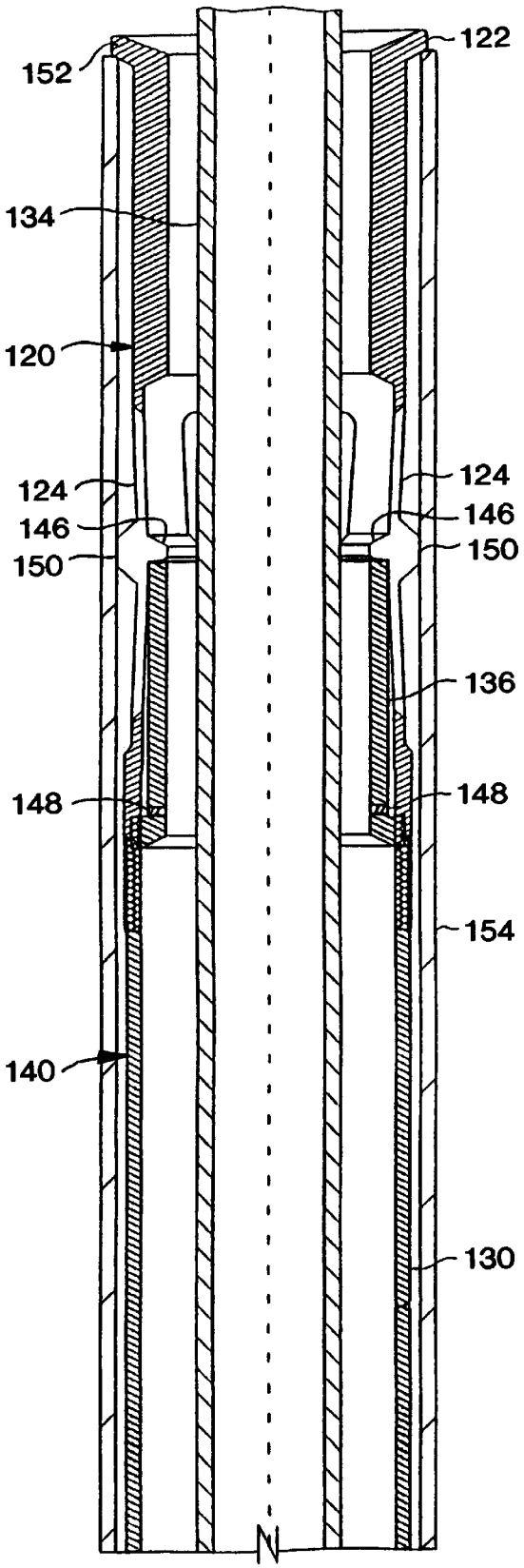
FIGS. 7A–7D are cross-sectional views of successive axial sections of the releasable deflection device of FIGS. 6A–6B, the device being shown in a released configuration.
Figure 7B:
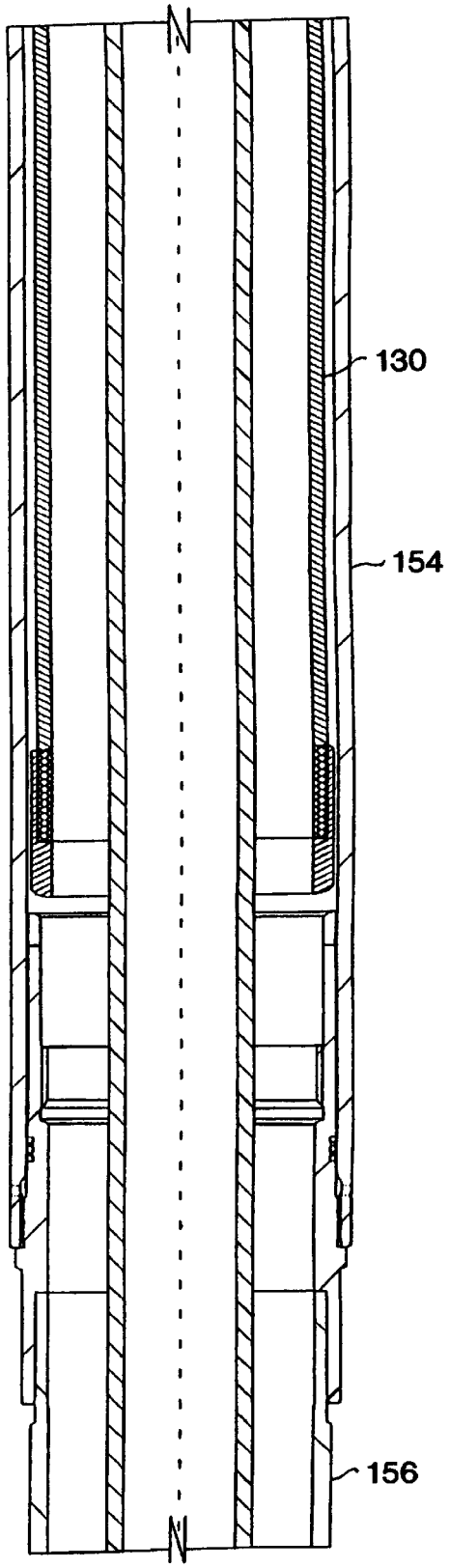
Figure 7C:
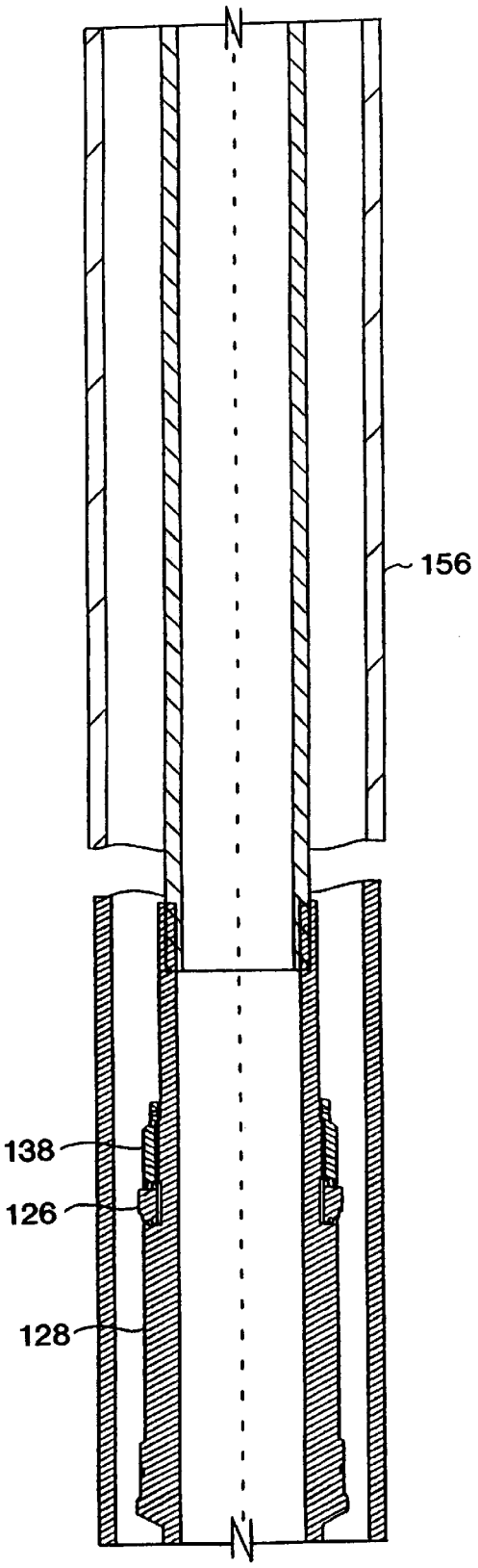
Figure 7D:
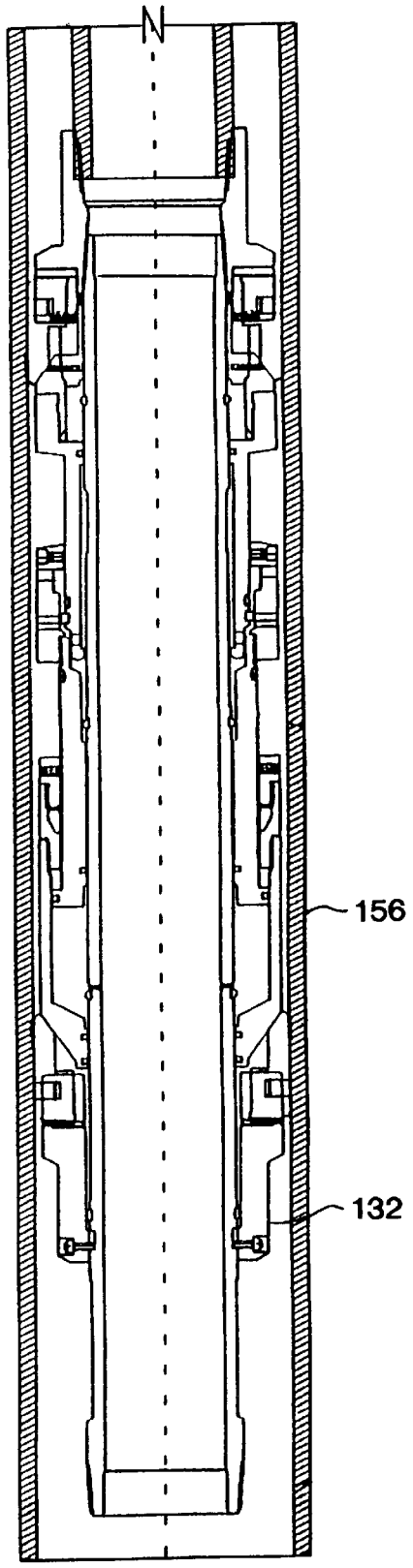

Referring additionally now to FIGS. 6A–6B, a deflection device 120 embodying principles of the present invention is representatively illustrated. The deflection device 120 may be utilized for the deflection device 62 in any of the methods described above wherein a deflection device is used. As described herein, the deflection device 120 is releasable upon engagement with a tubular structure and application of an axial force thereto, but it is to be clearly understood that the deflection device may be hydraulically, electrically, remotely, etc. released, without departing from the principles of the present invention.

The deflection device 120 is shown in FIGS. 6A–6B in a configuration in which it is run into a well. It includes an engagement portion 122, one or more release members 124, a blocking device 126, an inner generally tubular mandrel 128 and an outer generally tubular housing 130. The outer housing 130 is shown radially outwardly surrounding a representative item of equipment, a packer 132, but it is to be clearly understood that the housing may overlie any item of equipment, or any combination of equipment desired, with appropriate modification to the housing.

The packer 132 is threadedly attached to the inner mandrel 128, and the inner mandrel is threadedly attached to a tubing string 134 extending upwardly therefrom. As depicted in FIGS. 6A–6B, the inner mandrel 128 is prevented from displacing axially relative to the housing 130, release members 124 and engagement portion 122 by the blocking member 126. The blocking member 126 is representatively a generally C-shaped member which is radially outwardly disposed to engage a sleeve 136 threadedly attached to the housing 130. The blocking member 126 is retained on the inner mandrel 128 by a retainer 138 threadedly attached to the inner mandrel. Thus, with the blocking member 126 disposed between and contacting the retainer 138 and sleeve 136, the inner mandrel 128 is prevented from displacing downwardly relative to the housing 130. Additionally, the inner mandrel 128 is shouldered up against a lower portion of the sleeve 136, thereby preventing the inner mandrel from displacing upwardly relative to the housing 130.

The housing 130 is configured so that it will deflect off of a deflection surface, such as the deflection surface 28. For this purpose, for example, the housing 130 may have a larger diameter than the bore 36 of the whipstock 30, or may be otherwise shaped to prevent its insertion through another member. The housing is threadedly attached to the release members 124, sleeve 136 and engagement portion 122 (the engagement portion and release members being integrally formed as shown in FIG. 6A), thereby making up an outer assembly 140.

Preferably, the housing 130 extends downwardly past any items of equipment attached below the inner mandrel 128. In this manner, the housing 130 will contact any structure, such as a whipstock, prior to the equipment, and will permit the deflection device 120 to direct the tubing string 122 toward, for example, a lateral wellbore. FIG. 6B shows an end cap 142 of the housing 130 through which an end sub 144 of the packer 132 extends, but it is to be understood that, when the deflection device 120 is utilized in the methods described above, it is preferred that the end cap 142 completely overlie any item of equipment connected below the inner mandrel 128.

The release members 124 are axially elongated and circumferentially spaced apart, so that they are resilient, that is, they may be radially inwardly deflected. Note that a radially inwardly extending projection 146 formed on each release member 124 is in radial contact with the blocking member 126. Thus, it will be readily appreciated that if the release members 124 are radially inwardly deflected, the blocking member 126 will also be radially inwardly displaced thereby, and the inner mandrel 128 will no longer be secured by the blocking member relative to the outer assembly 140. However, one or more shear pins 148 installed through the sleeve 136 and into the mandrel 128 will still releasably secure the inner mandrel 128 against axial displacement relative to the outer assembly 140.

The release members 124 also have radially outwardly extending projections 150 formed thereon. The projections 150 extend radially outwardly so that, when the deflection device 120 is inserted within an appropriate tubular structure, the projections 150 will engage the tubular structure and be deflected radially inward thereby. In the representatively illustrated embodiment of the deflection device 120, the projections 150 are configured to permit radially inward deflection of the release members 124 upon insertion of the deflection device 120 into a PBR attached to a liner in a lateral wellbore. It is to be clearly understood, however, that the release members 124 may be otherwise configured for engagement with other structures, without departing from the principles of the present invention.

The engagement portion 122 is configured to engage the top of the PBR attached to the liner and prevent further insertion of the deflection device 120 into the liner. For this purpose, the engagement portion 122 has a radially outwardly extending flange 152 formed thereon, which has a greater diameter than the inner diameter of the liner PBR. However, it is to be clearly understood that the engagement portion 122 may be otherwise configured to engage a structure, without departing from the principles of the present invention.

Referring additionally now to FIGS. 7A–7D, the deflection device 120 is representatively illustrated inserted into a PBR 154 attached to a liner 156. The PBR 154 and liner 156 may, for example, correspond to the PBR 82 and liner 42 of the method 10 as depicted in FIG. 3. The release members 124 have been radially inwardly deflected by radial contact between the projections 150 and the inner diameter of the PBR 154. Such deflection of the release members 124 has caused the projections 146 to radially inwardly displace the blocking member 126. Thus, when the deflection device 120 is inserted into the PBR 154, the blocking member 126 no longer secures the inner mandrel 128 against displacement relative to the outer assembly 140.

Thereafter, an axially downwardly directed force may be applied to the inner mandrel 128 to shear the shear pins 148 and permit the inner mandrel and any equipment 132 attached thereto to downwardly displace relative to the outer assembly 140. Such downwardly directed force may be applied by slacking off on the tubing string 134 at the earth's surface. An opposing force is applied to the outer assembly 140 by engagement of the engagement portion 122 with the top of the PBR 154, the flange 152 thereby preventing further downward displacement of the outer assembly 140. The packer 132 is now permitted to displace downwardly into the liner 156 and may be set therein, with the outer assembly 140 remaining within the PBR 154.

Figure 8:
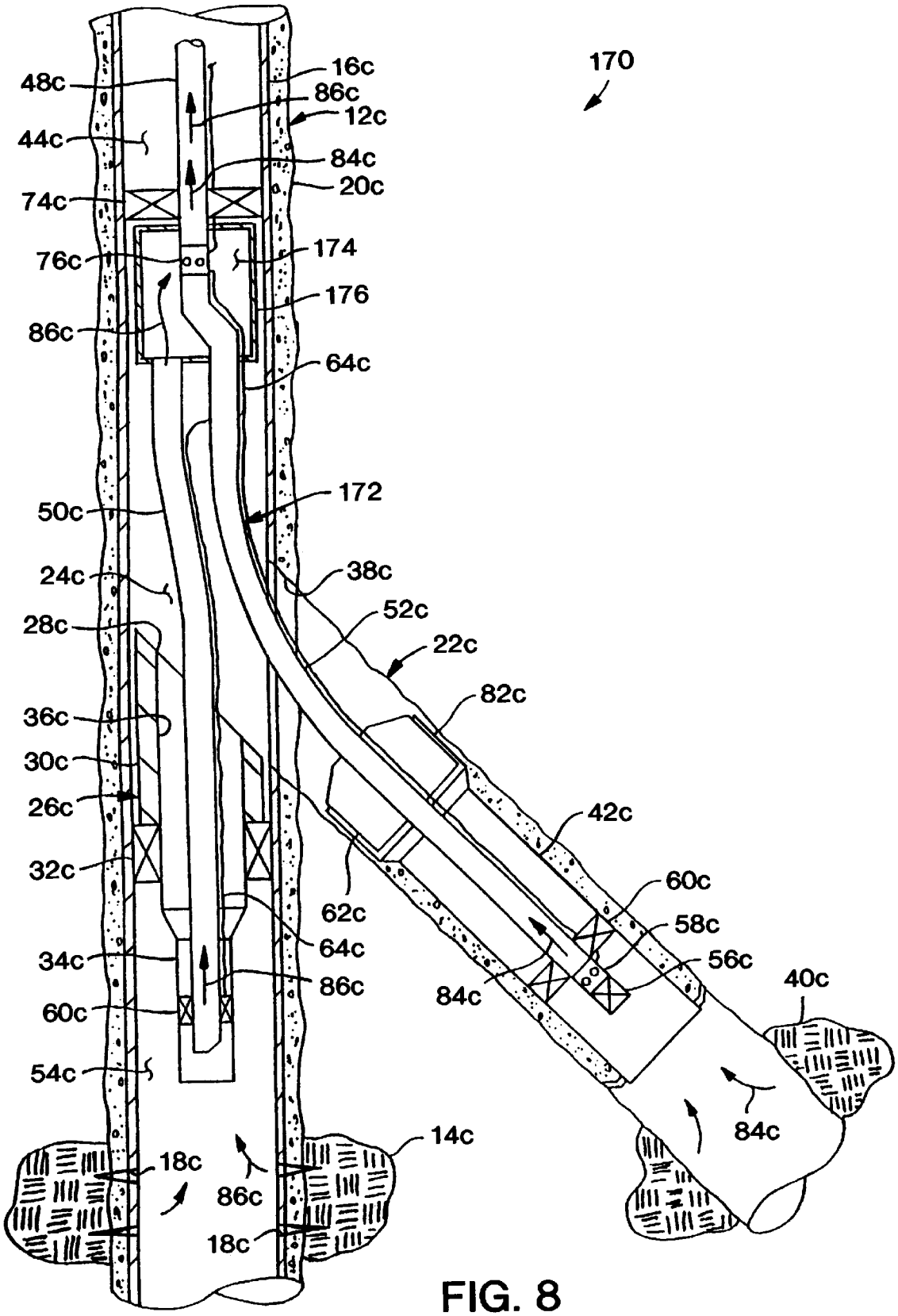
FIG. 8 is a schematic cross-sectional view of yet another well in which a fourth method and a fourth apparatus embodying principles of the present invention have been utilized.

Referring additionally now to FIG. 8, another method 170 embodying principles of the present invention is representatively and schematically illustrated. Elements of the method 170 which are similar to those previously described are indicated in FIG. 8 using the same reference number, with an added suffix "*c*". The method 170 differs in substantial part from the previously described method 10, in that packers 74, 66 are not utilized to isolate an annulus 80 from the remainder of the upper parent wellbore 44 as shown in FIG. 3. Instead, the method 170 utilizes an apparatus 172, which includes a fluid chamber 174 interconnected to the tubing strings 48*c*, 50*c*, 52*c*.

The fluid chamber 174 is contained within an outer housing 176, representatively illustrated in FIG. 8 as a generally tubular enclosure having a generally rectangular cross-section. Each of the tubing strings 48*c*, 50*c*, 52*c* is sealingly connected to the housing 176, with the interior of the tubing string 50*c* being in direct fluid communication with the chamber 174, and the interiors of the tubing strings 48*c*, 52*c* being in fluid communication with the chamber 174 only via the regulating device 76*c*. It is to be clearly understood, however, that the housing 176 may be otherwise shaped, may be otherwise interconnected to the tubing strings 48*c*, 50*c*, 52*c*, and may be integrally formed with other items of equipment included in the apparatus 172 (such as the regulating device 76*c*), without departing from the principles of the present invention.

The apparatus 172 is installed in the well in a manner similar to that described above for the apparatus 46 in the method 10. However, note that the tubing string 50*c* includes the packer 60*c*, which may be settable by application of fluid pressure thereto. Accordingly, the lines 64*c* are now extended to near the lower end of the tubing string 50*c* and interconnected to the packer 60*c*. Thus, when the apparatus 172 is positioned within the well as shown in FIG. 8, the two lower packers 60*c* and the upper packer 74*c* may be set sequentially or simultaneously by application of fluid pressure thereto. Of course, each of the packers 60*c*, 74*c*, or any combination of them, may be otherwise set without departing from the principles of the present invention.

When it is desired to produce the fluid 86 from the formation 14*c*, the regulating device 76*c* is opened. The fluid 86*c* may then flow from the formation 14*c*, into the lower end of the tubing string 50*c*, into the chamber 174, and inwardly through the regulating device 76*c* into the tubing string 48*c*. In an injection operation, the fluid 86*c* would flow in an opposite direction. The fluid 84*c* is produced or injected from or into the formation 40*c* in a manner similar to that described above for the method 10, flow of the fluid being controlled by the regulating device 58*c*.

It will, thus, be readily appreciated that the method 170 permits flow of each of the fluids 84*c*, 86*c*to be accurately, conveniently and remotely controlled. Such flow control is accomplished in close proximity to the formations 14*c*, 40*c*, thereby minimizing any wellbore storage effects, and is accomplished without requiring any intervention into the well to change the respective rates of flow of the fluids.

Of course, a person of ordinary skill in the art would find it obvious to make certain modifications, additions, deletions, substitutions and other changes to the various apparatus and methods described herein. Accordingly, the foregoing detailed description is to be clearly understood as being given by way of illustration and example only, the spirit and scope of the present invention being limited solely by the appended claims.

What is claimed is:

1. A method of completing a subterranean well, the method comprising the steps of:

interconnecting a first flow regulating device to first and second tubular strings;

providing fluid communication between the first regulating device and a fluid chamber; and interconnecting a third tubular string to the fluid chamber.

2. The method according to claim 1, further comprising the step of regulating fluid flow between the first tubular string and the third tubular string through the first regulating device.

3. The method according to claim 2, wherein the regulating step is remotely controlled.

4. The method according to claim 1, further comprising the step of regulating fluid flow through the second tubular string with a second flow regulating device interconnected to the second tubular string.

5. The method according to claim 1, further comprising the steps of sealingly engaging the second tubular string within a first wellbore portion of the well, and sealingly engaging the third tubular string within a second wellbore portion of the well, the second wellbore portion intersecting the first wellbore portion.

6. The method according to claim 1, wherein the providing step further comprises enclosing the chamber and the first regulating device within a housing.

7. A method of completing a subterranean well having first, second and third wellbore portions, the third wellbore portion extending to the earth's surface, and the first, second and third wellbore portions intersecting, the method comprising the steps of:

sealingly engaging a first tubular string including a first remotely controllable flow regulating device within the first wellbore portion;

sealingly engaging a second tubular string within the second wellbore portion; and interconnecting the first and second tubular strings to a third tubular string including a second remotely controllable flow regulating device, the flow regulating device regulating fluid flow between the third tubular string and a fluid chamber in fluid communication with the second tubular string.

8. The method according to claim 7, wherein the first and second regulating devices are remotely controllable via at least one line interconnected thereto.

9. The method according to claim 7, further comprising the step of operating the first regulating device to regulate fluid flow between the third tubular string and a formation intersected by the first wellbore portion.

10. The method according to claim 7, further comprising the step of operating the second regulating device to regulate fluid flow between the third tubular string and a first formation intersected by the second wellbore portion.

11. The method according to claim 10, further comprising the step of commingling in the third tubular string fluid produced from the first formation with fluid produced from a second formation intersected by the first wellbore portion.

12. The method according to claim 11, wherein the flow of the fluid produced from the second formation is regulated by the first regulating device.

13. The method according to claim 7, further comprising the steps of:

flowing a fluid between the third tubular string and a formation intersected by the second wellbore portion;

regulating flow of the fluid with the second regulating device; and flowing the fluid into a housing enclosing the chamber, the housing being interconnected to the first, second and third tubular strings.

14. Apparatus for completing a subterranean well, the apparatus comprising:

first, second and third tubular strings, the second tubular string having a length greater than that of the third tubular string;

a housing interconnecting the first, second and third tubular strings, the housing having a chamber disposed therein, the first tubular string extending outwardly from the housing in a first axial direction, and the second and third tubular strings extending outwardly from the housing in a second axial direction opposite to the first axial direction; and a releasable deflection device attached to the second tubular string.

15. The apparatus according to claim 14, further comprising an item of equipment attached to the second tubular string, and wherein the deflection device radially outwardly surrounds the item of equipment.

16. The apparatus according to claim 15, wherein the item of equipment is a flow regulating device.

17. The apparatus according to claim 16, wherein the flow regulating device is remotely controllable.

18. The apparatus according to claim 14, wherein the first tubular string is in fluid communication with the second tubular string.

19. The apparatus according to claim 18, further comprising a first flow regulating device, the first regulating device regulating fluid flow between the first tubular string and the chamber.

20. The apparatus according to claim 19, wherein the first regulating device is remotely controllable.

21. The apparatus according to claim 19, wherein the third tubular string is in fluid communication with the chamber.

22. The apparatus according to claim 21, wherein the chamber is in selectable fluid communication with the first and second tubular strings via a second flow regulating device, the second regulating device being interconnected to the first and second tubular strings.

23. The apparatus according to claim 22, wherein the second regulating device is remotely controllable.

24. Apparatus for completing a subterranean well, the apparatus comprising:

first, second and third tubular strings;

a housing interconnecting the first, second and third tubular strings, the housing including a fluid chamber in fluid communication with the third tubular string;

a first flow regulating device, the first regulating device regulating fluid flow between the second tubular string and the first tubular string; and a second flow regulating device, the second regulating device regulating fluid flow between the chamber and the first tubular string.

25. The apparatus according to claim 24, wherein the first and second regulating devices are remotely controllable.

26. The apparatus according to claim 24, further comprising a releasable deflection device operatively engaged with one of the second and third tubular strings.

27. The apparatus according to claim 24, wherein the second tubular string further includes a first sealing device interconnected between the first regulating device and the housing, and wherein the third tubular string further includes a second sealing device.

28. The apparatus according to claim 27, wherein at least one of the first and second sealing devices is remotely settable.

* * * * *